United States Patent [19]

Yeo

[11] Patent Number: 4,932,557

[45] Date of Patent: Jun. 12, 1990

[54] GARBAGE BAG CLIP

[75] Inventor: Donald G. Yeo, Islington, Canada

[73] Assignee: A-1 Products Corp., Toronto, Canada

[21] Appl. No.: 409,895

[22] Filed: Sep. 20, 1989

[51] Int. Cl.[5] ..... B65D 90/04

[52] U.S. Cl. ..... 220/404; 220/17

[58] Field of Search ..... 220/404, 403, 1 T, 410, 220/408

[56] References Cited

U.S. PATENT DOCUMENTS

| | | | |
|---|---|---|---|
| 3,130,853 | 4/1964 | Colthurst et al. | 220/404 |
| 3,757,990 | 9/1973 | Buth | 220/404 |
| 3,977,450 | 8/1976 | Schampier | 220/404 |
| 4,235,350 | 11/1980 | Valentino | 220/404 |
| 4,535,911 | 8/1985 | Goulter | 220/404 |
| 4,756,445 | 7/1988 | Agee, Sr. | 220/404 |
| 4,763,808 | 8/1988 | Gulte et al. | 220/404 |

*Primary Examiner*—Joseph Man-Fu Moy
*Attorney, Agent, or Firm*—Arne I. Fors

[57] ABSTRACT

A clip for securing a flexible bag to a rigid container is molded from synthetic plastic material and has a strip-like body portion, a first pointed projection extending from the lower surface of the body portion adjacent one end thereof, and a second pointed projection extending from the lower surface of the body portion adjacent an opposite end thereof. The first and second projections are snappable into a pair of spaced apertures in the rigid container, the second projection being shaped to pierce the flexible bag before being snapped into the aperture therefor so as to secure the flexible bag to the rigid container, and the second projection also being readily snappable out of the aperture to enable the flexible bag to be detached from the rigid container.

9 Claims, 5 Drawing Sheets

24
20
25
15
19
9
11
19
24
20
25
18
14
12
22
21
22
21
22
10

GARBAGE BAG CLIP

This invention relates to a clip for securing a flexible bag to a rigid container.

Rigid containers are now conventionally used to hold recyclable domestic refuse in a home so that they can be carried from inside the home to an outdoors location for pickup. Other recyclable refuse may be placed in a flexible plastic bag whose upper open end is usually closed by a tie extending therearound.

According to the present invention, a clip is provided for securing a flexible bag to a rigid container so that, when used with a flexible bag and rigid container for the purpose described above, a flexible bag containing one kind of recyclable refuse can be secured by the clip to a rigid container containing another kind of recyclable refuse The clip comprises a strip-like body portion having an upper surface and a lower surface, a first pointed projection extending from the lower surface of the strip-like body portion adjacent one end thereof, and a second pointed projection extending from the lower surface of the strip-like body portion adjacent an opposite end thereof. The first and second projections are snappable into a pair of spaced apertures in the container, the second projection being shaped to pierce the flexible bag before being snapped into the aperture therefor so as to secure the bag to the rigid container, the second projection also being readily snappable out of said aperture to enable the flexible bag to be detached from the rigid container.

The first projection may have a neck portion extending from a strip-like body portion, and a conical end portion extending from the neck portion.

The second projection may have a conical body portion extending from the strip-like portion, the conical body portion having a series of annular ribs spaced along the length thereof.

The opposite end of the strip-like body portion may be enlarged to provide a manually grippable portion to facilitate removal of the second projection from the aperture therefor in the rigid container.

The pair of apertures may be located in a substantially horizontal ledge portion extending from the upper end of a side wall of the rigid container.

One embodiment of the invention will now be described, by way of example, with reference to the accompanying drawings, of which;

Figure 1:
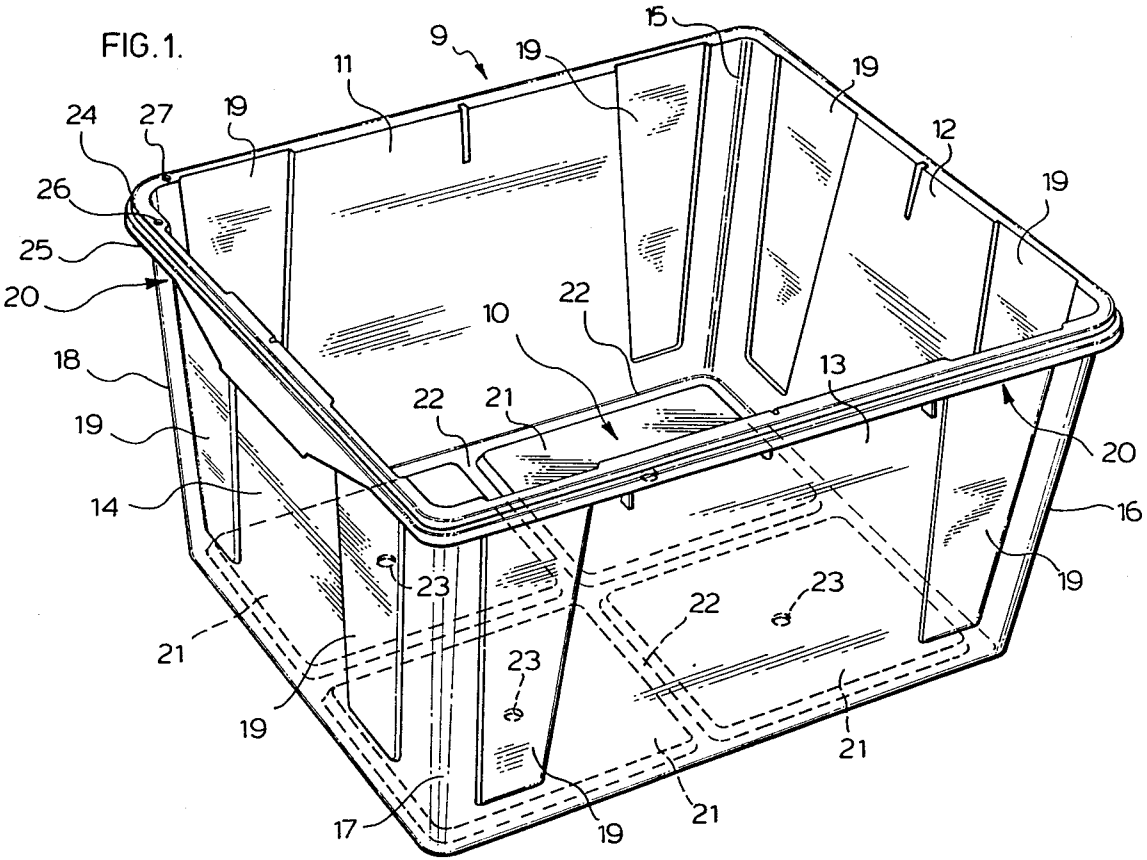
FIG. 1 is a perspective view of a rigid container.
Figure 2:
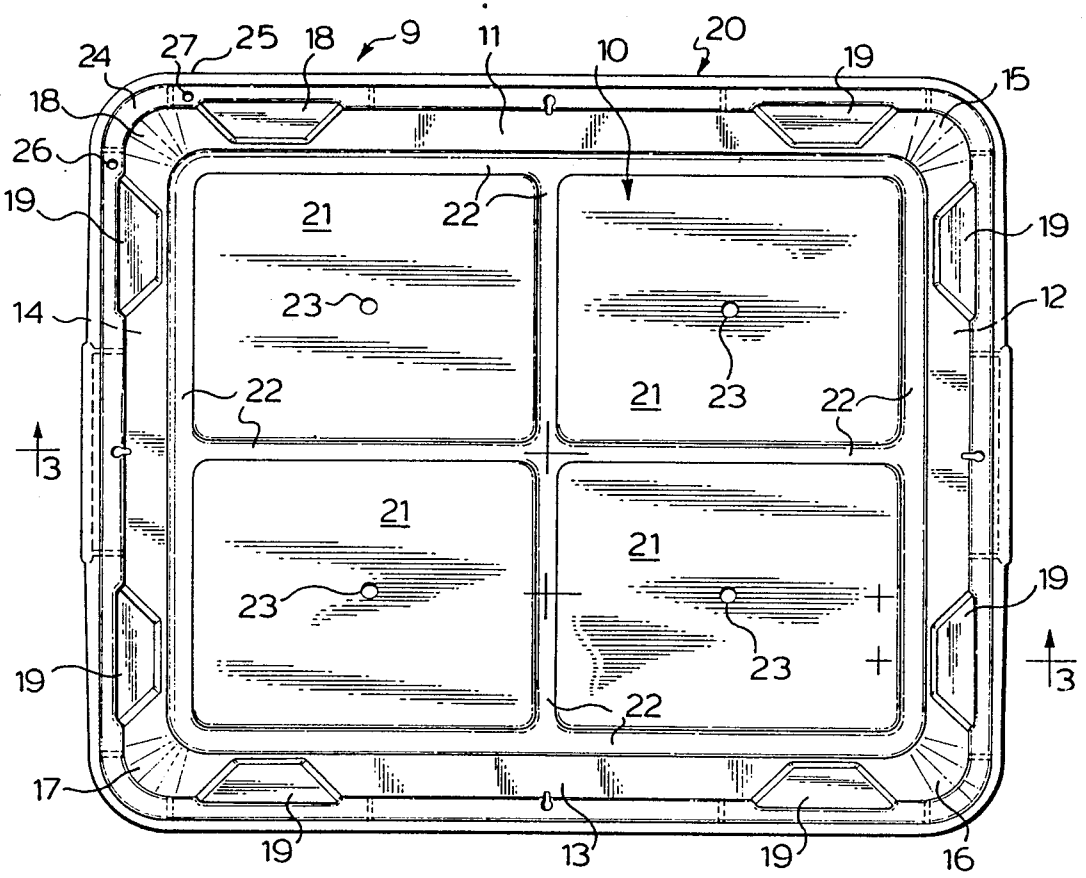
FIG. 2 is a plan view.
Figure 3:
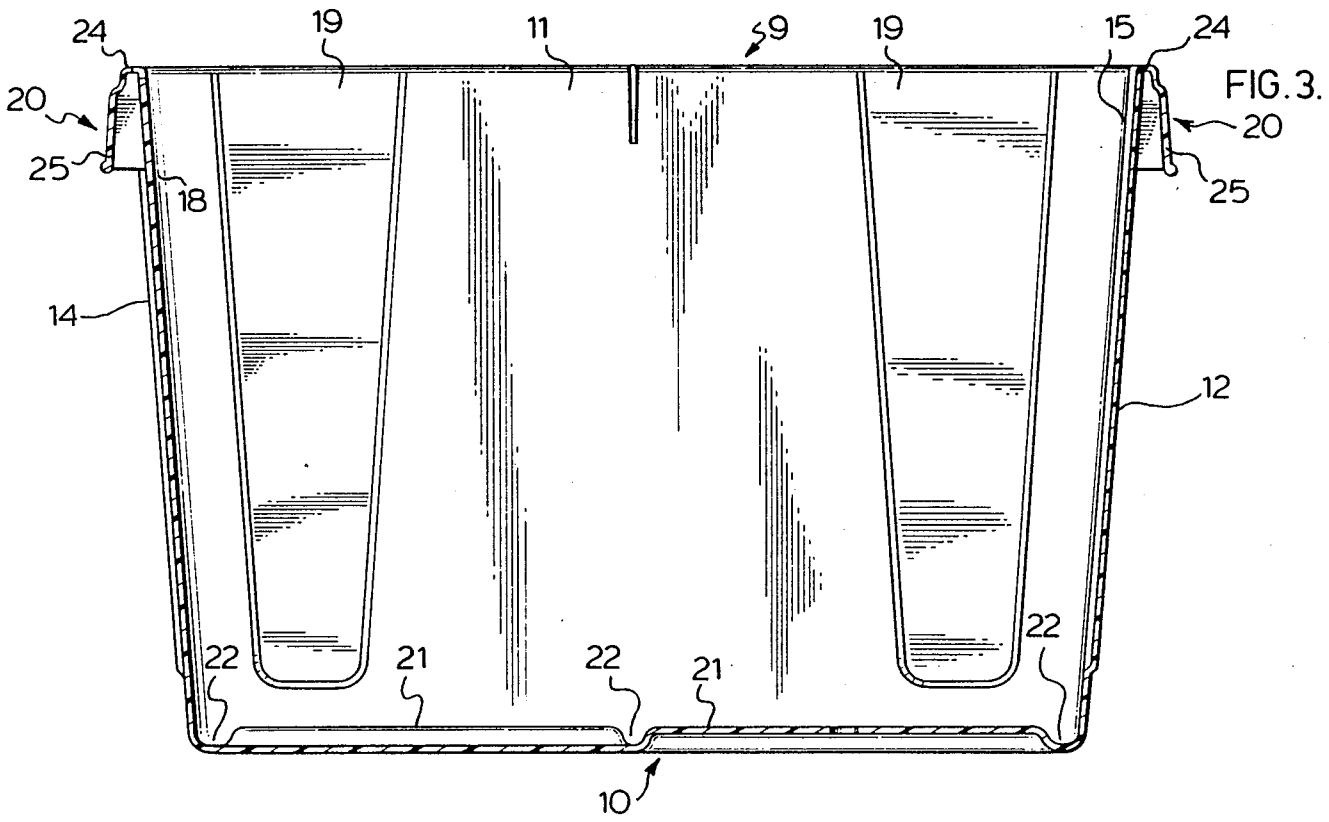
FIG. 3 is a vertical sectional view along the line 3—3 of FIG. 2.

Referring first to FIGS. 1 to 3 of the drawings, a rigid container 9 for recyclable refuse is an integral molding of suitable plastic material with a rectangular base 10 and four side walls 11, 12, 13, and 14 extending upwardly therefrom, the side walls 11 to 14 being integrally connected at respective corners 15, 16, 17 and 18. Each side wall 11 to 14 has a pair of vertical downwardly-tapering and lateral-spaced strengthening ribs 19, and a turned-over rim 20 extends around the upper edges of the side walls 11 to 14.

The base 10 has four rectangular flat raised portions 2 which occupies substantially the whole area of the base except that they are spaced from the side walls 11 to 14 and from each other by channel portions 22 Each flat raised portion 21 has a central aperture 23.

When recyclable refuse is placed in the container 9, it will be supported by the four flat raised portions 21. Any liquid in the refuse which seeps down to the bottom can collect in the channel portions 22, so that the refuse immediately adjacent to the flat raised portions 21 does not become waterlogged. If liquid overflows the channel portions 22, it will simply seep across the flat raised portions 22 and leak from the container 9 through the apertures 23. This may occur if the refuse has a high liquid content and/or if the container is left outdoors without a lid during rainfall.

The base is relatively strong because the combination of the flat raised portion 21 and the channel portions 22 serve to reinforce the base 10.

The turned-over rim 20 has a ledge portion 24 extending horizontally outwardly from the upper edges of the side walls 11 to 14, and a flange portion 25 extending downwardly and outwardly from the outer edge of the ledge portion 24. At one corner 18, the ledge portion 24 has a pair of apertures 26, 27 on opposite sides of the corner. The purpose of the apertures 26, 27 will be described later.

Figure 4:
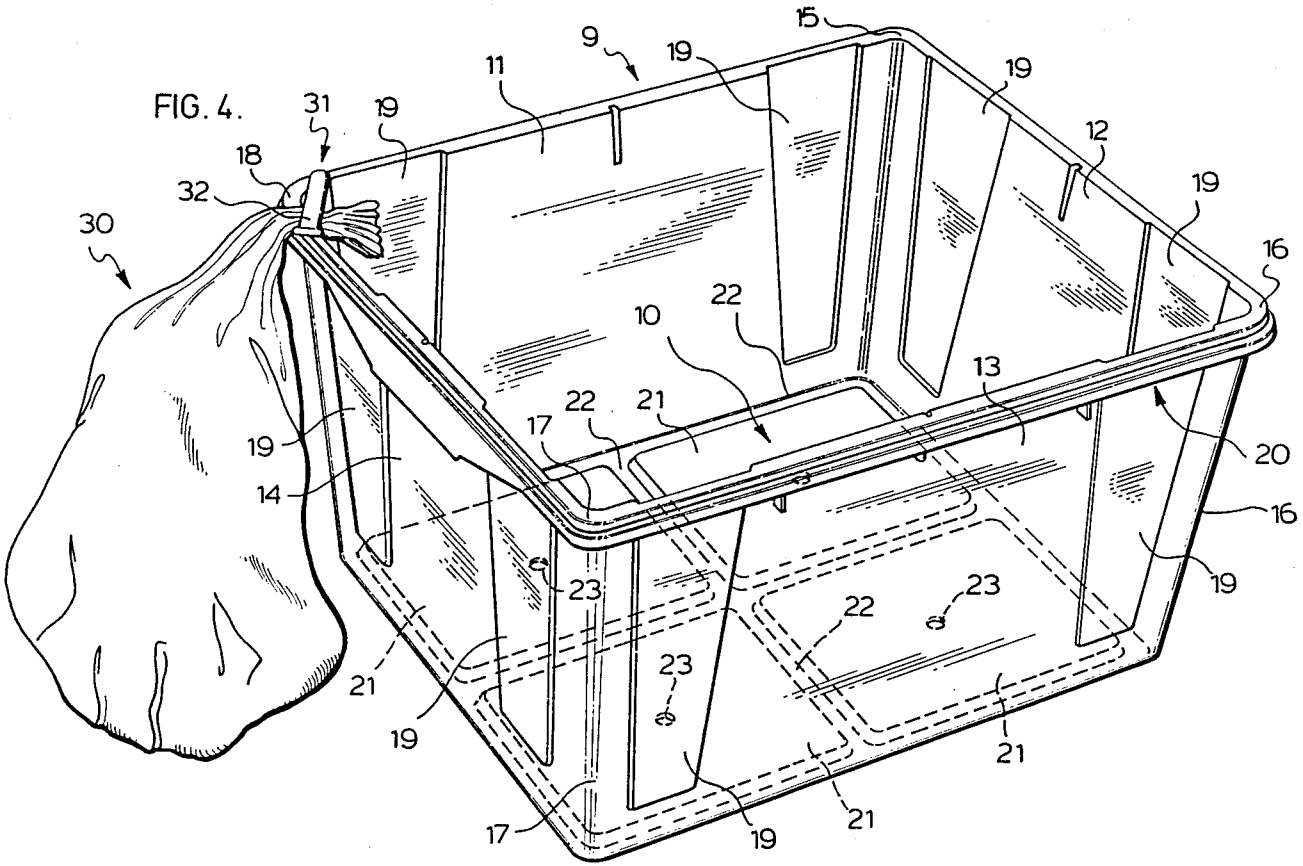
FIG. 4 is a perspective view similar to FIG. 1 but also showing a flexible bag secured to the container by a clip in accordance with the invention.
Figure 7:
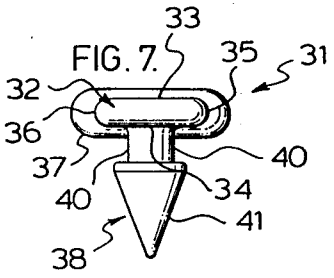
FIG. 7 is a left-hand end view.
Figure 8:
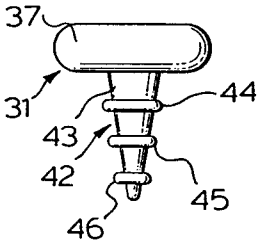
FIG. 8 is a right-hand end view.
Figure 5:
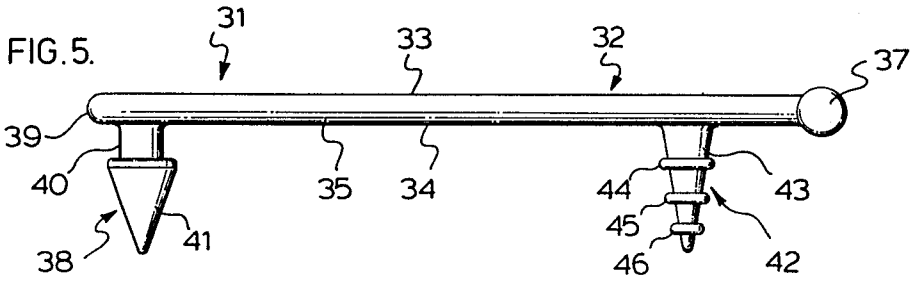
FIG. 5 is an enlarged side view of the clip.
Figure 6:
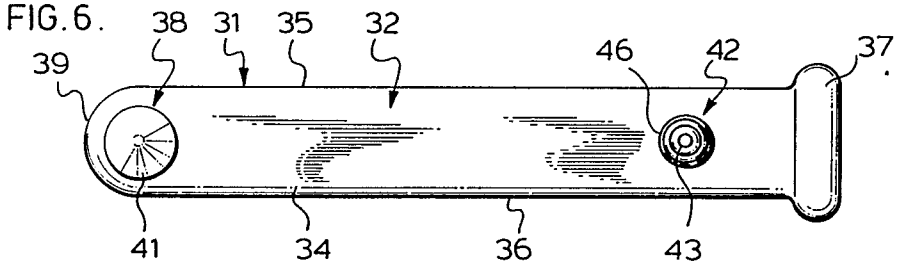
FIG. 6 is a bottom view.

FIG. 4 shows the rigid container 9 with a flexible bag 30 of plastic sheet material secured thereto by means of a clip 31 in accordance with the invention. The flexible bag 30 is of the kind commonly used for non-recyclable garbage, and its open upper end may be held closed by a flexible wire tie (not shown) also of conventional kind. With the present invention however, the flexible bag 30 is used for recyclable refuse of a kind different from that in the rigid container 9. For example, the flexible bag 30 may contain plastic bottles, while the rigid container 9 may be used for newspapers, glass bottles or metal cans. The flexible bag 30 will usually be up to about three-quarters full of refuse, so as to leave the upper end portion 32 laterally compressible to a small neck configuration where the flexible tie will be applied if such is used.

Before describing further the attachment of the flexible bag 30 to the container 9, the clip 31 will now be further described with reference to FIGS. 5 to 8. The clip 31 is an integral molding of suitable plastic material and has an elongated strip-like body 32 of generally rectangular section with flat upper and lower surfaces 33, 34 and outwardly curved sides 35, 36. One end of the body 32 has a transversely-extending cylindrical enlargement 37 which provides a hand grip as will be described in more detail later. The enlargement 37 extends above and below the upper and the lower surfaces 33, 34 of the clip body 32 respectively and also extends a short distance beyond the sides 35, 36.

A first projection 38 extends from the lower surface 34 of the lower body 32 adjacent the opposite end 39 to the transverse enlargement 37. The projection 38 has a neck portion 40 extending from the body 32, and a pointed conical end portion 41 extends from the neck portion 40. A second projection 42 extends from the lower surface of the body 32 near the transverse enlargement 37. The projection 42 has a conical body 43 extending from the main body 32, and a series of annular ribs 44, 45, 46 spaced along the length of the conical body 43.

In use, one kind of recyclable domestic refuse is placed in the rigid container 9, which may have a suitable lid (not shown) to protect the contents from rain. A flexible bag 30 containing another kind of recyclable garbage is secured to the rigid container 9 by use of a clip 31. The conical end portion 41 of the projection 38 is snapped through the aperture 27 in the ledge portion 24 of the container 9, so that the ledge portion 24 surrounds the neck 40 of the projection 38. This is a "semi-permanent" connection in that the projection 41 will usually be left in place in the aperture 27 in the ledge portion 24 but can be removed if desired.

The conical body 43 of the other projection 42 is pushed through the upper end portion 32 of the flexible bag 30 as shown in FIG. 4, and snapped through the aperture 26 in the ledge portion 24 of the container 9.

The flexible bag 30 can be detailed from the rigid container 9 when desired by snapping the projection 42 out of the aperture 26, and the transverse enlargement 37 can be manually gripped to facilitate such removal. As indicated above, the projection 38 will usually not be removed from its aperture 27 so that the clip 31 will remain attached to the rigid container 9 to await the securing of another flexible bag 30 thereto in due course.

The advantages of the invention will be readily apparent to a person skilled in the art, the scope of the invention being defined in the appended claims.

The embodiment of the invention in which an exclusive property or privilege is claimed are defined as follows:

1. A clip for securing a flexible bag to a rigid container, the clip being molded from synthetic plastic material and comprising a strip-like body portion having an upper surface and a lower surface, a first pointed projection extending from the lower surface of the body portion adjacent one end thereof, and a second pointed projection extending from the lower surface of the body portion adjacent an opposite end thereof, the first and second projections being snappable into a pair of spaced apertures in the rigid container, the second projection being shaped to pierce the flexible bag before being snapped into the aperture therefor so as to secure the flexible bag to the rigid container, the second projection also being readily snappable out of said aperture to enable the flexible bag to be detached from the rigid container.

2. A clip according to claim 1 wherein the first projection has a neck portion extending from the strip-like body portion, and a conical end portion extending from the neck portion.

3. A clip according to claim 1 wherein the second projection has a conical body portion extending from the strip-like body portion, and the conical body portion has a series of annular ribs spaced along the length thereof.

4. A clip according to claim 1 wherein the opposite end of the strip-like body portion is enlarged to provide a manually grippable portion to facilitate removal of the second projection from the aperture therefor in the rigid container.

5. An assembly comprising a rigid container and a flexible bag secured thereto by a clip, (a) said rigid container having a base with side walls extending upwardly therefrom, at least one of the side walls having a substantially horizontal ledge portion at an upper end thereof, and the ledge portion having a pair of spaced apertures extending therethrough, (b) the clip having been molded from synthetic plastic material and comprising a strip-like body portion having an upper surface and a lower surface, a first pointed projection extending from the lower surface of the body portion adjacent one end thereof, and a second pointed projection extending from the lower surface of the body portion adjacent an opposite end thereof, (c) the flexible bag being of flexible plastic sheet material, (d) the first projection of the clip being in snapping engagement in one of the apertures in the ledge portion of the rigid container, and the second projection of the clip passing through an upper end portion of the flexible garbage bag and being in removable snapping engagement in the other aperture in the rigid container ledge portion to secure the flexible garbage bag to the rigid container.

6. An assembly according to claim 5 wherein the first projection has a neck portion extending from the strip-like body portion, and a conical end portion extending from the neck portion.

7. An assembly according to claim 5 wherein the second projection has a conical body portion extending from the strip-like body portion, and the concical body portion has a series of annular ribs spaced along the length thereof.

8. An assembly according to claim 5 wherein the opposite end of the strip-like body portion is enlarged to provide a manually grippable portion to facilitate removal of the second projection from the aperture in the container.

9. An assembly according to claim 5 wherein said pair of apertures are located in a substantially horizontal ledge portion extending from the upper end of a side wall of the rigid container.

* * * * *